United States Patent [19]

Schlurensauer

[11] 3,982,763

[45] Sept. 28, 1976

[54] CHANCE CONTROLLED CROSS-OUT APPARATUS

[75] Inventor: Ludwig Schlurensauer, Montrose, N.Y.

[73] Assignee: Lawrence Peska Associates, Inc., New York, N.Y. ; a part interest

[22] Filed: July 16, 1975

[21] Appl. No.: 596,388

[52] U.S. Cl. ..... 273/135 D; 273/147

[51] Int. Cl.[2] ..... A63F 3/00

[58] Field of Search ..... 273/1 R, 130 R, 130 E, 273/135 R, 135 D, 147, 135 AA, 135 AC

[56] References Cited

UNITED STATES PATENTS

| | | | |
|---|---|---|---|
| 2,794,644 | 6/1957 | Johnson | 273/147 |
| 3,077,677 | 2/1963 | Malkin | 273/130 E |
| 3,405,943 | 10/1968 | Marsh | 273/135 D |
| 3,480,278 | 11/1969 | Conley | 273/130 E |
| 3,734,506 | 5/1973 | Gingrass | 273/130 E |

*Primary Examiner*—Anton O. Oechsle
*Assistant Examiner*—Marvin Siskind
*Attorney, Agent, or Firm*—Richard E. Nanfeldt

[57] ABSTRACT

A word game called "X-Out Word Game" includes a plurality of score cards each having at least four words printed thereon, wherein the words are four to six letters in length. An indicator device for selecting an alphabet letter to be crossed out of a word on the score card. The device includes two sections rotatably joined together, wherein one section has alphabet letters thereon and the other section has alphabet letters and numbers thereon. The device is rolled on a table so as to select the letters or numbers.

5 Claims, 5 Drawing Figures

CHANCE CONTROLLED CROSS-OUT APPARATUS

BACKGROUND OF THE INVENTION

U.S. Pat. Nos. 779,229; 830,514; and 1,034,633 to Manfield; 1,591,639 to Mcdonald; 2,766,987 to Seelbrede et al; and 3,215,435 to Rheingruber all relate to word spelling games; however, these aforementioned patents are nonapplicable to my present invention which employs an indicator means which is rolled on a planar surface for the purpose of selecting alphabet letters and numbers.

SUMMARY OF THE INVENTION

My present invention relates to a unique and novel word game called X-Out Word Game which is played by each player on his own score sheet.

It is an object of my present invention to provide a word game, wherein one letter of a given word on a score sheet is crossed out at a time from a four to six letter word contained on the score sheet.

It is a further object of my present invention to provide a means for selecting which letter is to be crossed out from the word on the score sheet, wherein the indicator means is a two sectional member in which the sections are rotatably joined together. One section has alphabet letters thereon and the other section has alphabet letters and numbers thereon.

Briefly, my present invention comprises a plurality of score cards each having at least four words printed thereon, wherein the words are four to six letters in length. An indicator device for selecting an alphable letter to be crossed out of a word on the score card. The device includes two sections rotatably joined together, wherein one section has alphabet letters thereon and the other section has alphabet letters and numbers thereon. The device is rolled on a table so as to select the letters or numbers.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
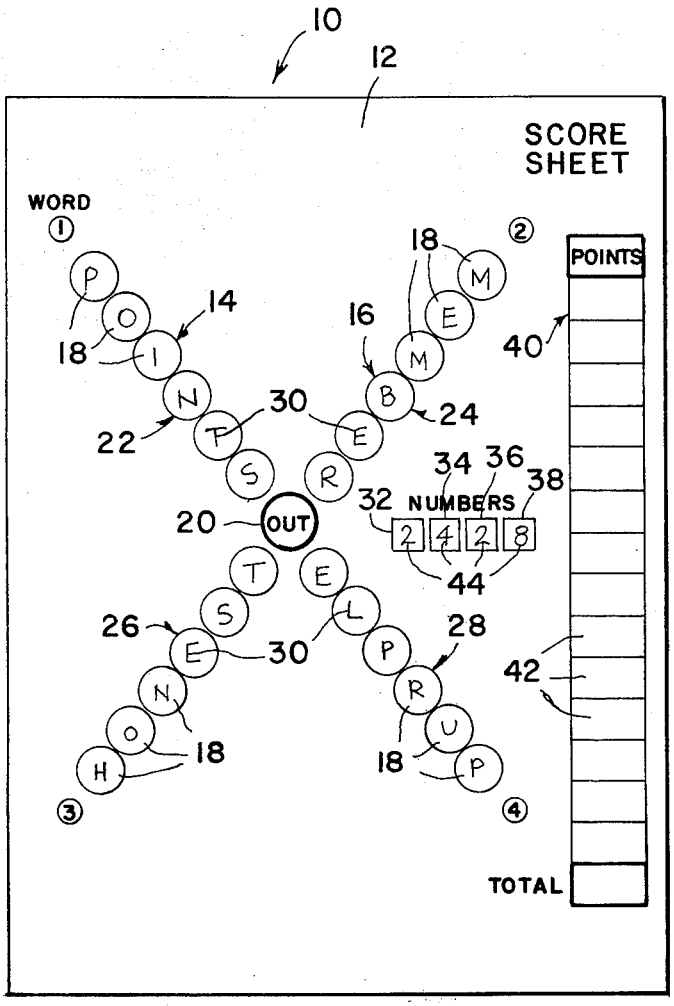
FIG. 1 illustrates a top planar view of a score card of a word game.
Figure 2:
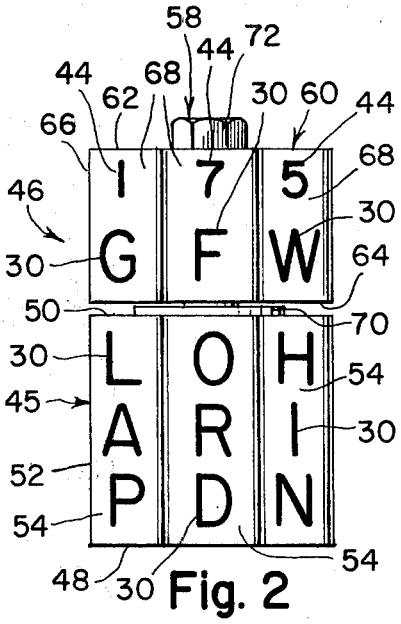
FIG. 2 illustrates a side view of an indicator means for the word game.
Figure 3:
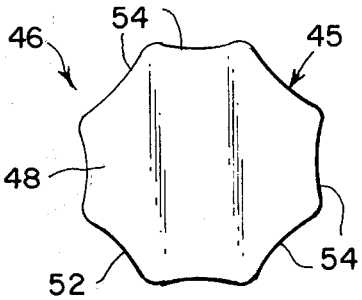
FIG. 3 illustrates a bottom view of the indicator means.
Figure 4:
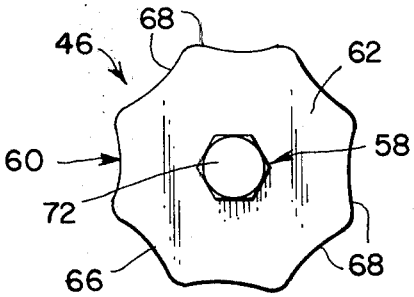
FIG. 4 illustrates a top view of the indicator means.
Figure 5:
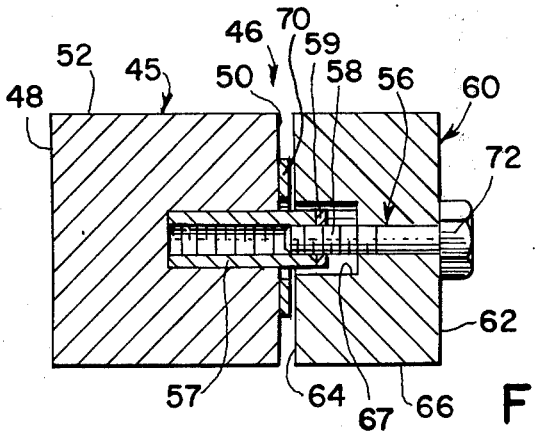
FIG. 5 illustrates a side cross sectional view of the indicator means.

Turning now descriptively to the drawings, in which similar reference characters denote similar elements throughout the several views, FIG. 1 shows a score card 10 for a game called X-Out Word Game. The score card 10 comprises a sheet of paper 12 having thereon two rows 14, 16 of thirteen individual circles 18 each, wherein the rows are crossed in the shape of an X such that the center circle 20 of each row 14, 16 forms the cross point of the X, thereby forming four columns 22, 24, 26, 28 of six circles each. A six letter word is printed in each column 22, 24, 26, 28 of six circles 18, wherein one individual letter 30 of the alphabet is contained in each circle 18. The word out is printed in the center circle 20. A set of four squares 32, 34, 36, 38 is contained on the score card 10. A vertical column 40 of a plurality of boxes 42 is also contained on the score card 10 for keeping the score of the player. Alternatively, the rows 14, 16 can be nine, or eleven circles 18 each, wherein four or five letter words are in each column 22, 24, 26, 28.

FIGS. 2-5 show a means for indicating the letter 30 or a number 44 to be recorded onto the score card 10. The means comprises a two sectional cylindrically shaped member 46 which is rolled on a table. Member 46 consists of a cylindrically shaped bottom section 45 having a base 48, a top 50, a circumferential periphery 52. The circumferential periphery 52 is divided into eight longitudinal faces 54 wherein each face 54 extending from the top 50 to the base 48. Each face 54 has a slight concave curvative therein and is of a different color. A long each face 54 extending from the top 50 to the base 48 are contained three alphabetical letters 30. These arrangement of letters 30 for the eight faces 54 are; LAP; ORD; HIN; EYS; AMB; OUT; VIZ; and UIZ. A bolt member 56 extends perpendicularly upward from bushing 57 in the center of the top 50, wherein the inner end 58 of the bolt member 56 is externally threaded. The top cylindrically shaped section 60 has a top 62, a base 64, a circumferential periphery 66 and a center longitudinal bore 67 extending half way through. The circumferential periphery 66 is divided into eight longitudinal faces 68, wherein each face 68 extends from the top 62 to the base 64. Each face 68 has a slight concave curvative therein and is of a different color which corresponds to the colors of faces 54. Each face 68 has an alphabetic letter 30 and a number 44 thereon, wherein the number 44 is disposed towards the top 62. The arrangement of a number 44 and a letter 30 for the eight faces 68 are as follows: 1G; 7F; 5W; 8C; 2K; 3J; 6X; and 4Q. The rod member 56 extends through the bore 67 of the top section 60, wherein the base 64 of section 60 is disposed towards the top 50 of section 45. A washer 70 is contained on rod member 56 between sections 46, 60, wherein the washer functions as a space means. The head 72 of the bolt member 56 engages the top 62 of section 60. Section 60 rotates freely relative to section 45 as the member 46 is rolled along a planar top.

The game is played as follows: each player is issued a score card. Each player writes four numbers 44 in squares 32, 34, 36, 38 and forms six letter words of his choice in the four columns 22, 24, 26, 28. The first player rolls the member 46, wherein four letters 30 and one number 44 are face up. The player may select one of the four letters to cross out in the first six letter word in column 22. If the first number 44 in square 32 appears on member 46, he may also cross out this number 44. The player must cross out all letters 30 in the six letter word in column 22 before going onto the next six letter word in column 22. The player may not cross out the number 44 in the second square 34 until the number 44 in the first square is crossed out. The players continues to roll the member 46 until one player has crossed out the four six letter words plus the word out in circle 20. The word out has to be rolled after crossing out the four six letter words. If a player rolls the alphabetic letter — X, he may cross out one extra letter 30 of his choice. If letters are rolled which the player cannot use, he forfeits that turn. The first player to cross out each word is awarded 10 points. The first player to cross out the four six letter words plus Out is awarded 15 points. If a player rolls X out, he is awarded 15 points. If a color match between the faces 54, 68 of sections 45, 60 occurs the player is awarded additional points. The first player to cross out all four numbers 44 in squares 32, 34, 36, 38 is awarded ten points. The player with the most points at the end of the game is the winner.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A word game which comprises:

a. a score card having four squares and two rows of circles thereon, each row having at least nine circles, said rows of circles crossing in an X-shape, each of said circles adapted to receive one indicia corresponding to an alphabetic letter therein, and each of said squares adapted to receive indicia corresponding to one number therein; and b. means for rolling indicia identically corresponding to said alphabetic letter indicia and said numerical indicia simultaneously, said means comprising a bottom cylindrically shaped section having a top, a base, and a circumferential periphery, said periphery divided into eight longitudinal faces, each face extending from said top to said base; a top cylindrically shaped section having a top, a base, and a circumferential periphery, said periphery divided into eight longitudinal faces, each face extending from said top to said base; three of said alphabetic letter indicia on each face of said bottom section; one of said alphabetic letter indicia and one of said numerical indicia contained on each face of said top section; and means for rotatably joining said top of said bottom section to said base of said top section whereby the member is rolled and one of the face-up alphabetic letter indicia and one of the number indicia may be crossed off the score card.

2. A word game according to claim 1, wherein each said face of said bottom section is different in color, said color of one said face of said bottom section identical in color to one said face of said top section.

3. A word game according to claim 1, wherein said faces of said bottom and top sections have a concave curvative.

4. A word game according to claim 1, wherein said means for rotatably joining together said top and bottom sections comprises:

a. an elongated bolt affixed perpendicularly to a bushing in said top of said bottom section, said elongated rod having an externally threaded free end;

b. said top section having a center longitudinal bore therethrough, said elongated bolt member extending through said bore; said head of said bolt engaging said top of said top section; and c. a spacer means on said rod disposed between said top and bottom sections.

5. A word game according to claim 4, wherein said spacer means is a washer.

* * * * *